US009583047B2

(12) United States Patent
Seki

(10) Patent No.: US 9,583,047 B2
(45) Date of Patent: Feb. 28, 2017

(54) IMAGE DISPLAY DEVICE, CONTROL METHOD FOR IMAGE DISPLAY DEVICE, AND RECORDING MEDIUM RECORDING CONTROL PROGRAM

(71) Applicant: Sharp Kabushiki Kaisha, Osaka-shi, Osaka (JP)

(72) Inventor: Fumitaka Seki, Osaka (JP)

(73) Assignee: Sharp Kabushiki Kaisha, Sakai (JP)

( * ) Notice: Subject to any disclaimer, the term of this patent is extended or adjusted under 35 U.S.C. 154(b) by 0 days.

(21) Appl. No.: 14/419,047

(22) PCT Filed: Sep. 4, 2013

(86) PCT No.: PCT/JP2013/073759

§ 371 (c)(1),
(2) Date: Feb. 2, 2015

(87) PCT Pub. No.: WO2014/038572

PCT Pub. Date: Mar. 13, 2014

(65) Prior Publication Data

US 2015/0161951 A1 Jun. 11, 2015

(30) Foreign Application Priority Data

Sep. 6, 2012 (JP) ..... 2012-196342

(51) Int. Cl.
*G09G 3/36* (2006.01)
*G09G 3/34* (2006.01)

(52) U.S. Cl.
CPC ..... *G09G 3/3406* (2013.01); *G09G 3/36* (2013.01); *G09G 2320/0247* (2013.01);
(Continued)

(58) Field of Classification Search
CPC G09G 3/3406; G09G 3/36; G09G 2320/0247; G09G 2320/0626; G09G 2320/0646; G09G 2360/16; G09G 2320/062
See application file for complete search history.

(56) References Cited

U.S. PATENT DOCUMENTS 6,115,018 A * 9/2000 Okumura ..... G09G 3/3648 345/210
6,184,969 B1 2/2001 Fergason
(Continued)

FOREIGN PATENT DOCUMENTS

JP 2007-018013 A 1/2007
JP 2008-309908 A 12/2008
(Continued)

*Primary Examiner* — Andrew Sasinowski
*Assistant Examiner* — Gerald Oliver
(74) *Attorney, Agent, or Firm* — Keating & Bennett, LLP

(57) ABSTRACT

A control device executes a program including the steps of: when an unintended black image is detected, notifying a target value of brightness of a backlight and a correction amount of brightness of an image immediately before the black image is detected, until a predetermined time elapses; correcting the image based on the notified correction amount of the brightness of the image; causing a liquid crystal panel to display the corrected image; and controlling the backlight based on the notified target value of the brightness of the backlight.

8 Claims, 4 Drawing Sheets

(52) U.S. Cl.
CPC ..... *G09G 2320/062* (2013.01); *G09G 2320/0626* (2013.01); *G09G 2320/0646* (2013.01); *G09G 2360/16* (2013.01)

(56) References Cited

U.S. PATENT DOCUMENTS

| | | | | |
|---|---|---|---|---|
| 8,670,079 | B2 * | 3/2014 | Adachi | G06T 5/009 348/739 |
| 2008/0001881 | A1 * | 1/2008 | Baba | G09G 3/3406 345/89 |
| 2008/0309610 | A1 | 12/2008 | Yoshida et al. | |
| 2010/0134643 | A1 * | 6/2010 | Koishi | G03B 29/00 348/222.1 |

FOREIGN PATENT DOCUMENTS

| | | | | |
|---|---|---|---|---|
| JP | 2009-300722 | A | 12/2009 | |
| JP | 2010-256915 | A * | 11/2010 | G09G 5/10 |
| JP | WO 2012086532 | A1 * | 6/2012 | G02B 27/2228 |

* cited by examiner

IMAGE DISPLAY DEVICE, CONTROL METHOD FOR IMAGE DISPLAY DEVICE, AND RECORDING MEDIUM RECORDING CONTROL PROGRAM

TECHNICAL FIELD

The present invention relates to a technique of adjusting the brightness of a light source and the brightness of an image in accordance with the lightness of the image.

BACKGROUND ART

For example, Japanese Patent Laying-Open No. 2007-018013 (PTD 1) discloses a display device which increases the amount of light from a light source for illumination when an input signal has a high brightness, and decreases the amount of light from the light source for illumination when the input signal has a low brightness. In addition, Japanese Patent Laying-Open No. 2008-309908 discloses an image display device which raises the level of a video signal or the level of brightness when the level of the video signal is low for more than a certain time.

CITATION LIST

Patent Document

PTD 1: Japanese Patent Laying-Open No. 2007-018013
PTD 2: Japanese Patent Laying-Open No. 2008-309908

SUMMARY OF INVENTION

Technical Problem

There is known a technique in which, when an image to be displayed in an image display device including a liquid crystal panel and a light source (for example, a backlight) has a low lightness, an increase of power consumption amount in the light source is suppressed without significantly changing appearance by gradually making changes to decrease the brightness of the light source and increase the brightness of the image.

However, when a light image is displayed, then a black image which is unrelated to the image displayed until then is displayed for a certain time, and thereafter display of a light image is restored, the brightness of the light source is decreased and the brightness of the image is increased from the time when the black image is displayed. Therefore, when the display of the light image is restored, the brightness of the light source is increased and the brightness of the image is decreased from the time of the restoration, as time elapses. As a result, when the display of the light image is restored, the display looks darker than that before the black image is displayed, which may result in occurrence of flicker and deterioration of display quality.

The present invention has been made to solve the aforementioned problem, and one object of the present invention is to provide an image display device suppressing deterioration of display quality, a control method for the image display device, a control program for the image display device, and a recording medium recording the control program.

Solution to Problem

An image display device in accordance with an aspect of the present invention includes a liquid crystal panel displaying an image, a light source illuminating the liquid crystal panel, and a control device correcting brightness of the light source and brightness of the image. In a case where a plurality of images are displayed continuously, when a black image is detected from the plurality of images, the control device suppresses correction of the brightness of the light source and the brightness of the image until a predetermined time elapses after the black image is detected.

Preferably, in the case where the plurality of images are displayed continuously, when the black image is detected and a difference in lightness between the black image and an image detected immediately before has a magnitude larger than a threshold value, the control device suppresses the correction of the brightness of the light source and the brightness of the image until the predetermined time elapses after the black image is detected.

More preferably, in a case where detection of the black image continues for more than or equal to the predetermined time, the control device cancels suppression of the correction of the brightness of the light source and the brightness of the image.

More preferably, the control device makes correction to increase the brightness of the image while decreasing the brightness of the light source as the image has a lower lightness, and makes correction to decrease the brightness of the image while increasing the brightness of the light source as the lightness is higher.

More preferably, the predetermined time is set such that there occurs no flicker due to the correction of the brightness of the light source and the brightness of the image based on detection of the black image.

More preferably, the control device determines whether or not the image is a black image based on a histogram of the image.

A control method for an image display device in accordance with another aspect of the present invention is a control method for an image display device including a liquid crystal panel displaying an image and a light source illuminating the liquid crystal panel. The control method includes the steps of: correcting brightness of the light source and brightness of the image; and, in a case where a plurality of images are displayed continuously, when a black image is detected from the plurality of images, suppressing correction of the brightness of the light source and the brightness of the image until a predetermined time elapses after the black image is detected.

A control program for an image display device in accordance with still another aspect of the present invention is a control program for an image display device including a liquid crystal panel displaying an image and a light source illuminating the liquid crystal panel. The control program causes a computer to perform the steps of: correcting brightness of the light source and brightness of the image; and, in a case where a plurality of images are displayed continuously, when a black image is detected from the plurality of images, suppressing correction of the brightness of the light source and the brightness of the image until a predetermined time elapses after the black image is detected.

A recording medium in accordance with still another aspect of the present invention is a recording medium recording a control program for an image display device as described above.

Advantageous Effects of Invention

According to the present invention, in a case where a plurality of images are displayed continuously, when a black image is detected from the plurality of images, correction of the brightness of the light source and the brightness of the image is suppressed until a predetermined time elapses after the black image is detected. Thereby, occurrence of flicker due to changes in the brightness of the light source and the brightness of the image based on the detection of the black image can be suppressed. Therefore, an image display device suppressing deterioration of display quality, a control method for the image display device, a control program for the image display device, and a recording medium recording the control program can be provided.

DESCRIPTION OF EMBODIMENTS

Figure 1:
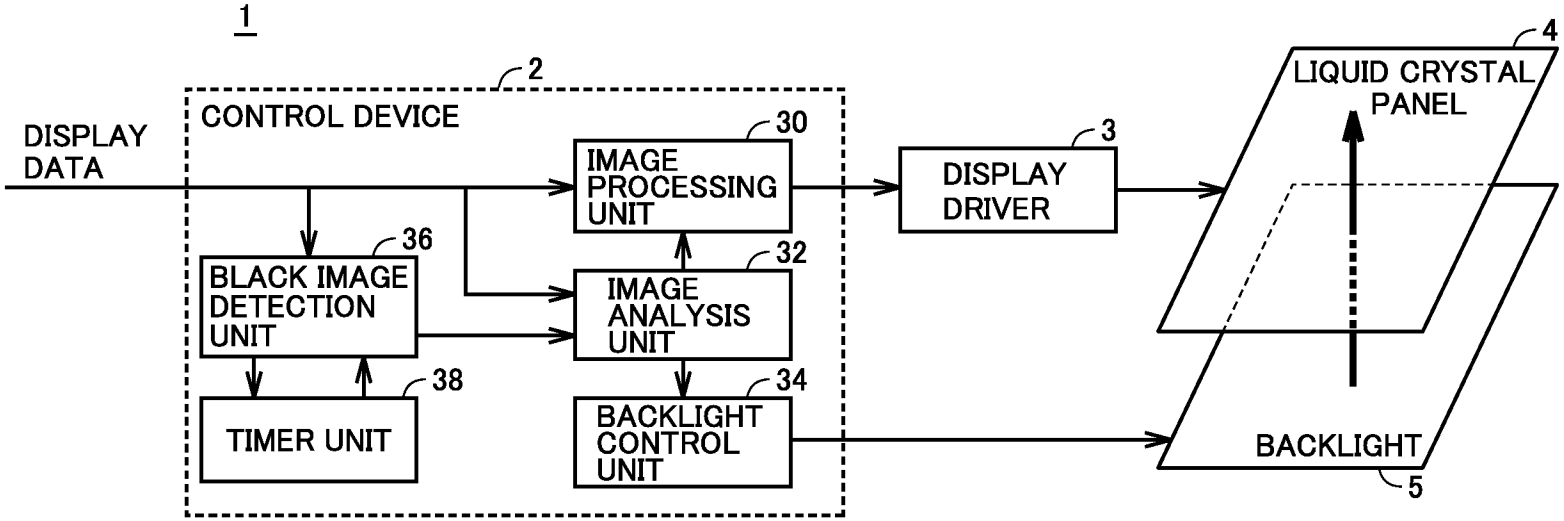
FIG. 1 is a schematic block diagram of an image display device in accordance with the present embodiment.

Hereinafter, an embodiment of the present invention will be described with reference to the drawings. In the description below, identical parts will be designated by the same reference numerals. Since their names and functions are also the same, the detailed description thereof will not be repeated.

As shown in FIG. 1, an image display device 1 in accordance with the present embodiment includes a control device 2, a display driver 3, a liquid crystal panel 4, and a backlight 5.

Display data is input to control device 2. The display data includes data for displaying an image of one frame on liquid crystal panel 4. For example, the display data is read from a storage device not shown, and is input to control device 2. The storage device is, for example, a rewritable recording medium such as a memory, a hard disk, or the like. The memory is, for example, a NAND-type flash memory.

Control device 2 generates a control signal based on the input display data, and transmits the generated control signal to display driver 3 and backlight 5. Display driver 3 applies a voltage to liquid crystal panel 4 based on the control signal received from control device 2.

Liquid crystal panel 4 receives the voltage applied by display driver 3 and displays an image. Backlight 5 is a light source which illuminates liquid crystal panel 4 based on the control signal received from control device 2.

Such image display device 1 may be used, for example, for a monitor mounted in a mobile terminal such as a smart phone terminal or a tablet terminal or in a laptop-type personal computer, or a stationary monitor, a liquid crystal television, and the like.

Control device 2 corrects brightness BL of backlight 5 and the brightness of an image included in the display data. Control device 2 corrects brightness BL of backlight 5 and the brightness of the image without causing a significant change in the appearance of the image (that is, while maintaining the lightness of the entire image).

Control device 2 makes correction, for example, to increase the brightness of the image while decreasing brightness BL of backlight 5, as the image has a lower lightness (as the image is darker). Alternatively, control device 2 makes correction, for example, to decrease the brightness of the image while increasing brightness BL of backlight 5, as the image has a higher lightness (as the image is lighter).

Control device 2 increases or decreases the brightness of the image by changing each pixel value of the image. In addition, control device 2 suppresses occurrence of flicker by gradually changing brightness BL of backlight 5 and the brightness of the image.

A case where a plurality of images are displayed continuously in the image display device having such a configuration is assumed. In this case, when a light image is displayed, then a black image which is unrelated to the image displayed until then is displayed for a certain time, and thereafter display of a light image is restored, flicker may occur due to correction of brightness BL of backlight 5 and the brightness of the image, and display quality may be deteriorated. This is because, since the display of the light image is restored after correction is made from the time when the black image is displayed to decrease the brightness of the light source and increase the brightness of the image, correction is made from the time of the restoration to increase the brightness of the light source and decrease the brightness of the image. Such a phenomenon may occur, for example, in a case where the image display device is used for a terminal, and a start-up image is displayed when the terminal is started.

The present embodiment is characterized in that, in a case where a plurality of images are displayed continuously, when a black image is detected from the plurality of images, control device 2 suppresses correction of brightness BL of backlight 5 and the brightness of the image until a predetermined time elapses after the black image is detected.

Control device 2 includes an image processing unit 30, an image analysis unit 32, a backlight control unit 34, a black image detection unit 36, and a timer unit 38.

Image processing unit 30 corrects the brightness of the image included in the display data based on a correction amount C of the brightness of the image notified from image analysis unit 32, and outputs the corrected image to display driver 3. Specifically, when image processing unit 30 is notified of correction amount C of the brightness of the image from image analysis unit 32, image processing unit 30 changes the brightness of the image by notified correction amount C.

It is noted that image processing unit 30 gradually changes the brightness of the image by notified correction amount C. For example, image processing unit 30 may set an upper limit value for a change amount of the brightness of the image, and may change the brightness of the image step by step or continuously such that the correction amount of the brightness of the image comes close to correction amount C notified from image analysis unit 32 as time elapses.

Alternatively, for example, image processing unit 30 may determine a value obtained by multiplying a difference between the brightness of an image determined immediately before and the brightness of an image changed by notified correction amount C, by a coefficient smaller than 1, as the brightness of a current image.

In accordance with the lightness of the image included in the display data, image analysis unit 32 calculates a target value of brightness BL of backlight 5 and correction amount C of the brightness of the image. For example, image analysis unit 32 converts the image into gray scale images with 256 gradations using a well-known method, and produces a histogram showing the lightness and distribution of each pixel based on the lightness of each pixel. For the image included in the display data, image analysis unit 32 calculates the target value of brightness BL of backlight 5 and correction amount C of the brightness of the image, based on the produced histogram.

Image analysis unit 32 calculates the target value of brightness BL of backlight 5 and correction amount C of the brightness of the image, to increase brightness BL of backlight 5 and decrease the brightness of the image, as the image is lighter.

Further, image analysis unit 32 calculates the target value of brightness BL of backlight 5 and correction amount C of the brightness of the image, to decrease brightness BL of backlight 5 and increase correction amount C of the brightness of the image, as the image is darker.

For example, image analysis unit 32 may determine that an image included in the display data is lighter, as the number of pixels having a lightness more than a predetermined lightness in the image is larger, or as the number of pixels having a lightness less than the predetermined lightness in the image is smaller, and may calculate the target value and correction amount C to increase brightness BL of backlight 5 and decrease the brightness of the image.

Alternatively, for example, image analysis unit 32 may determine that an image included in the display data is darker, as the number of pixels having a lightness more than a predetermined lightness in the image is smaller, or as the number of pixels having a lightness less than the predetermined lightness in the image is larger, and may calculate the target value and correction amount C to decrease brightness BL of backlight 5 and increase the brightness of the image.

It is noted that a change amount of brightness BL of backlight 5 and correction amount C of the brightness of the image are set to values having correlation to prevent a significant change in the appearance of the image. Further, the predetermined lightness is not particularly limited.

Image analysis unit 32 notifies backlight control unit 34 of the calculated target value of brightness BL of backlight 5. In addition, image analysis unit 32 notifies image processing unit 30 of calculated correction amount C of the brightness of the image.

In the present embodiment, when image analysis unit 32 is notified of the detection of an unintended black image from black image detection unit 36, image analysis unit 32 suppresses correction of brightness BL of backlight 5 and the brightness of the image until a predetermined time elapses after it is notified.

For example, when image analysis unit 32 is notified of the detection of an unintended black image from black image detection unit 36, image analysis unit 32 may notify backlight control unit 34 of the target value of brightness BL of backlight 5 calculated based on an image immediately before the detection of the black image, and notify image processing unit 30 of correction amount C of the brightness of the image calculated based on the image immediately before the detection of the black image.

Alternatively, for example, when image analysis unit 32 is notified of the detection of an unintended black image from black image detection unit 36, image analysis unit 32 may notify backlight control unit 34 to maintain brightness BL of backlight 5, and notify image processing unit 30 to maintain correction amount C of the brightness of the image.

When image analysis unit 32 is notified from black image detection unit 36 that the detection of the black image continues for more than or equal to the predetermined time, image analysis unit 32 cancels suppression of the correction of brightness BL of backlight 5 and the brightness of the image. That is, image analysis unit 32 calculates the target value of brightness BL of backlight 5 and correction amount C of the brightness of the image, based on the detected black image.

Backlight control unit 34 generates a control signal for controlling brightness BL of backlight 5 based on the target value of brightness BL of backlight 5 notified from image analysis unit 32, and transmits the generated control signal to backlight 5.

Specifically, when backlight control unit 34 is notified of the target value of brightness BL of backlight 5 from image analysis unit 32, backlight control unit 34 controls brightness BL of backlight 5 such that brightness BL of backlight 5 reaches the notified target value.

It is noted that backlight control unit 34 gradually changes brightness BL of backlight 5 until brightness BL of backlight 5 reaches the notified target value of brightness BL of backlight 5. For example, backlight control unit 34 sets an upper limit value for the change amount of brightness BL of backlight 5, and changes brightness BL of backlight 5 step by step or continuously such that brightness BL of backlight 5 comes close to the target value as time elapses.

Black image detection unit 36 determines whether or not an image included in the display data is an unintended black image. When black image detecting unit 36 determines that the image is an unintended black image, black image detection unit 36 notifies image analysis unit 32 of the detection of the black image. For example, when all of the pixels of an image included in the display data have a pixel value indicating black, black image detection unit 36 may determine that the image included in the display data is a black image. Alternatively, when the number of pixels having a pixel value indicating black is more than a threshold value, black image detection unit 36 may determine that the image included in the display data is a black image. Alternatively, when the number of pixels having a lightness lower than a predetermined lightness is more than a threshold value, black image detection unit 36 may determine that the image included in the display data is a black image. The threshold value or the predetermined lightness may be determined considering noise superimposed on the image included in the display data, and the like.

Further, when the black image is detected and a difference in lightness between the black image and an image immediately before the detection of the black image has a magnitude larger than a threshold value, black image detection unit 36 determines that an unintended black image is detected. The threshold value is, for example, a value for determining a case where a light image is displayed and then a black image which is unrelated to an immediately preceding image is inserted.

When the detection of the black image continues for more than or equal to the predetermined time based on elapsed time notified from timer unit 38, black image detection unit 36 notifies image analysis unit 32 of the continuation.

In a case where an unintended black image is not detected, timer unit 38 resets the value of a counter to an initial value (i.e., initializes the value of the counter). In a case where an unintended black image is detected, timer unit 38 increases the value of the counter as time elapses when the counter is reset to the initial value. When the counter has a value corresponding to the predetermined time, timer unit 38 stops increasing the value of the counter. Timer unit 38 notifies black image detection unit 36 of the value of the counter whenever it increases the value of the counter.

Processing in image processing unit 30, image analysis unit 32, backlight control unit 34, black image detection unit 36, and timer unit 38 is implemented by hardware, or by software executed by a CPU. Such software is stored in the storage device. Further, the software may be stored in a memory card or another storage medium and distributed as a program product. Alternatively, the software may be provided as a downloadable program product by an information provider connected to the so-called Internet. Such software may be read from the storage medium by an IC card reader writer or another reading device, or may be downloaded, and thereafter stored in the storage device in the form of an executable program.

Figure 2:
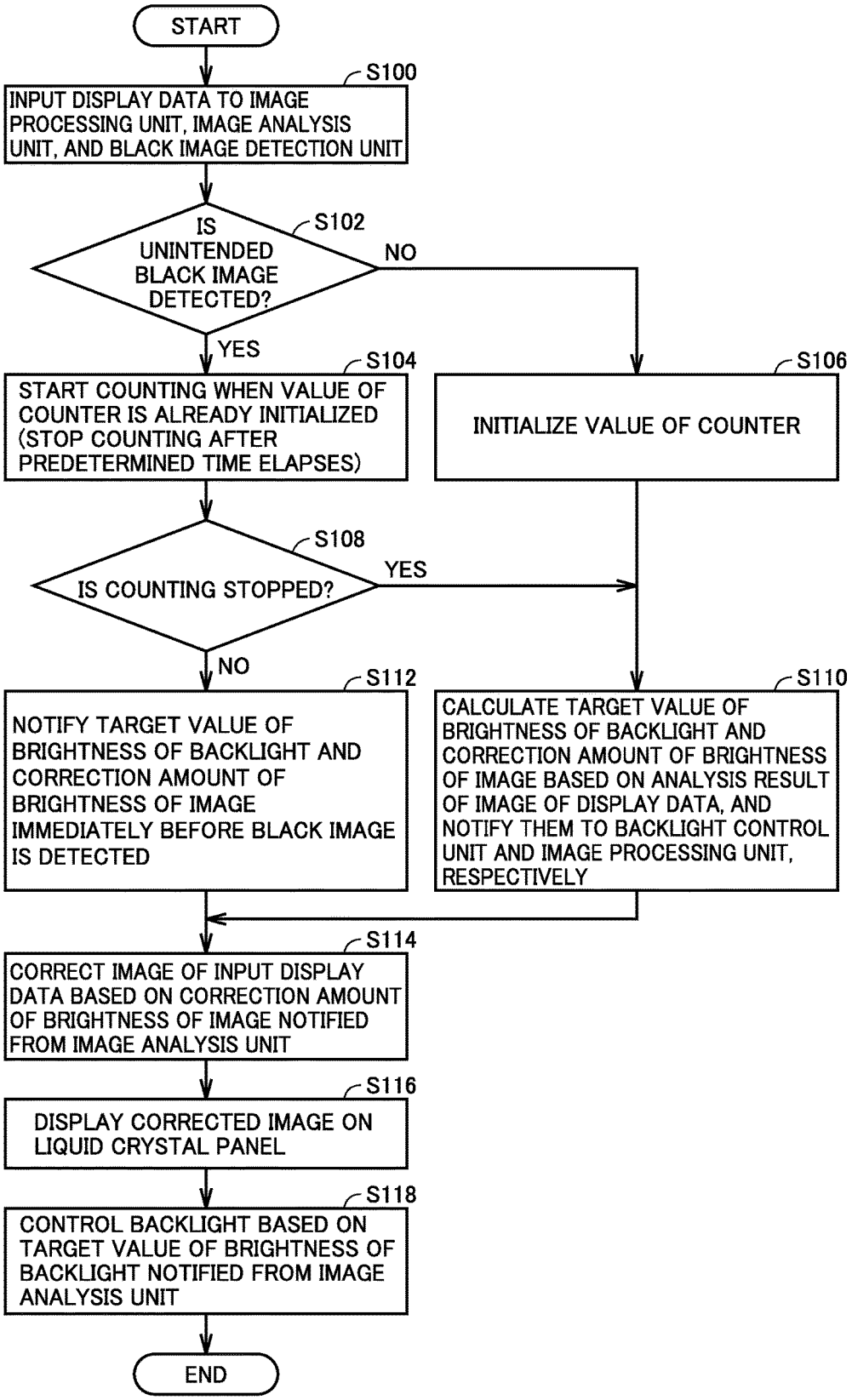
FIG. 2 is a flowchart illustrating a control structure of a program executed by the image display device in accordance with the present embodiment.

Referring to FIG. 2, a control structure of a program executed by control device 2 of image display device 1 in accordance with the present embodiment will be described.

In step (hereafter abbreviated as S) 100, control device 2 inputs display data to image processing unit 30, image analysis unit 32, and black image detection unit 36.

In S102, black image detection unit 36 determines whether or not an unintended black image is detected, based on an image included in the display data. When an unintended black image is detected (YES in S102), the processing proceeds to S104. Otherwise (NO in S102), the processing proceeds to S106.

In S104, when the value of the counter is already initialized (that is, when the value of the counter is an initial value), timer unit 38 starts increasing the value of the counter (counting), and stops counting after a predetermined time elapses. In S106, timer unit 38 initializes the value of the counter.

In S108, timer unit 38 determines whether or not the counting is stopped. When the counting by timer unit 38 is stopped (YES in S108), the processing proceeds to S110. Otherwise (NO in S108), the processing proceeds to S112.

In S110, based on the lightness of the image of the input display data, image analysis unit 32 calculates the target value of brightness BL of backlight 5 and notifies backlight control unit 34 of the calculated target value, and calculates correction amount C of the brightness of the image and notifies image processing unit 30 of calculated correction amount C.

In S112, image analysis unit 32 notifies backlight control unit 34 of the target value of brightness BL of backlight 5 immediately before the black image is detected, and notifies image processing unit 30 of correction amount C of the brightness of the image immediately before the black image is detected. In S114, image processing unit 30 corrects the brightness of the image included in the display data, based on correction amount C of the brightness of the image notified from image analysis unit 32.

In S116, image processing unit 30 causes liquid crystal panel 4 to display the corrected image. In S118, backlight control unit 34 controls brightness BL of backlight 5, based on the target value of brightness BL of backlight 5 notified from image analysis unit 32.

An operation of control device 2 of image display device 1 in accordance with the present embodiment based on the structure and flowchart as described above will be described with reference to FIGS. 3 and 4.

<In a Case where the Present Invention is Applied>

Figure 3:
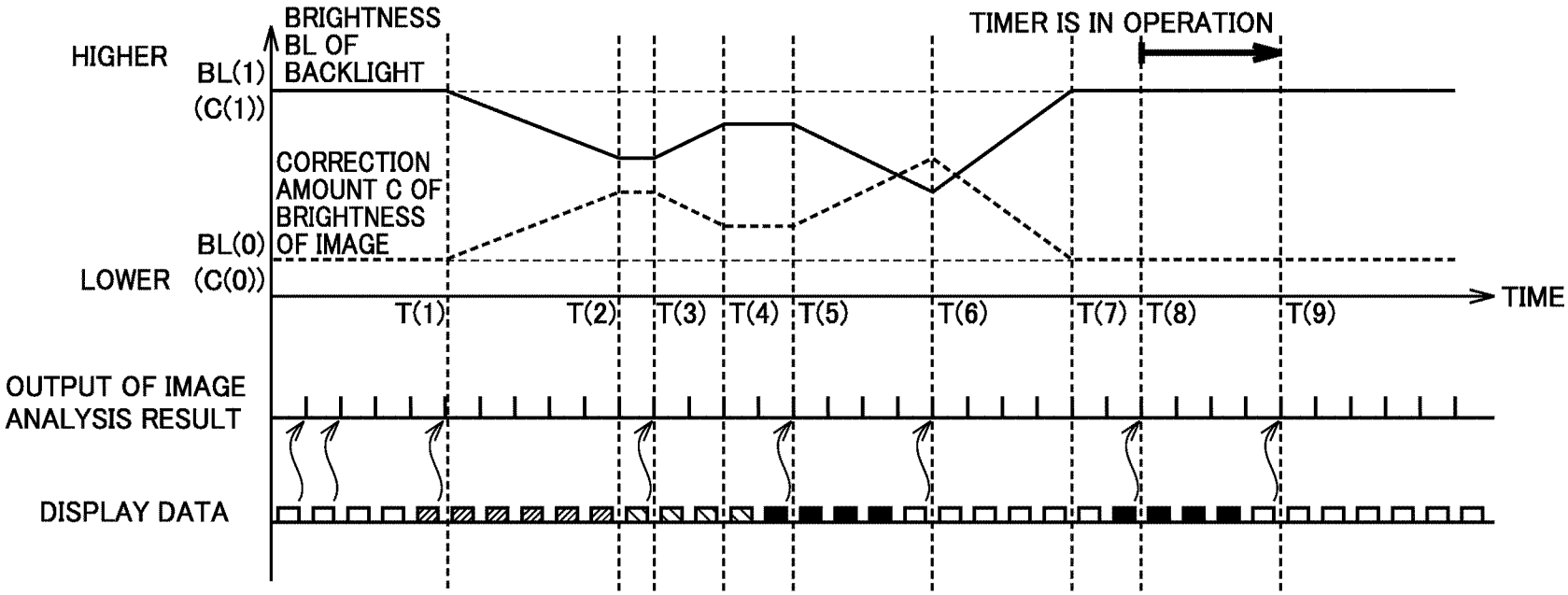
FIG. 3 is a timing chart illustrating an operation of a control device in a case where the present invention is applied.

As shown in FIG. 3, for example, a case where a light image is input to control device 2 as display data is assumed. Control device 2 inputs the display data to image processing unit 30, image analysis unit 32, and black image detection unit 36 (S100).

When a black image is not detected (NO in S102), timer unit 38 initializes the value of the counter (S106). Based on the lightness of the image included in the display data, image analysis unit 32 calculates the target value of brightness BL of backlight 5 and correction amount C of the brightness of the image, and notifies backlight control unit 34 of the calculated target value of brightness BL of backlight 5 and notifies image processing unit 30 of calculated correction amount C of the brightness of the image (S110).

On this occasion, since the image included in the display data is a light image, the target value of brightness BL of backlight 5 is set to an upper limit value BL(1), and correction amount C of the brightness of the image is set to a lower limit value C(0). Image processing unit 30 corrects the brightness of the image based on notified correction amount C (S114), and causes liquid crystal panel 4 to display the corrected image (S116). Backlight control unit 34 controls backlight 5 based on the notified target value of brightness BL of backlight 5 (S118). As a result, until time T(1) until which the light image is displayed, brightness BL of backlight 5 is maintained at upper limit value (1), and correction amount C of the brightness of the image is maintained at lower limit value C(0).

In a case where an image input as display data is a dark image (not a black image), the target value of brightness BL of backlight 5 is set to a value lower than upper limit value BL(1) of the brightness of backlight 5. In addition, correction amount C of the brightness of the image is set to a value higher than lower limit value C(0) of correction amount C of the brightness of the image.

As a result, after time T(1), brightness BL of backlight 5 decreases as time elapses, until it reaches the target value at time T(2). In addition, correction amount C of the brightness of the image increases from time T(1), as time elapses, until it reaches notified correction amount C at time T(2). Since correction amount C of the brightness of the image increases while brightness BL of backlight 5 decreases, power consumption in backlight 5 can be reduced without significantly changing how the image is seen by a user.

At time T(2), when brightness BL of backlight 5 reaches the notified target value and correction amount C of the brightness of the image reaches the notified correction amount, brightness BL of backlight 5 and correction amount C of the brightness of the image are maintained.

At time T(3), in a case where an image input as display data is an image lighter than the immediately preceding image, the target value of brightness BL of backlight 5 is set to a value higher than the target value of brightness BL of backlight 5 determined at time T(1) to time T(3) based on the lightness of the display data. In addition, correction amount C of the brightness of the image is set to a value lower than correction amount C of the brightness of the image determined at time T(1) to time T(3).

As a result, from time T(3) to time T(4), brightness BL of backlight 5 increases, whereas correction amount C of the brightness of the image decreases, as time elapses.

At time T(4) to time T(5), when brightness BL of backlight 5 reaches the notified target value and correction amount C of the brightness of the image reaches the notified correction amount, brightness BL of backlight 5 and correction amount C of the brightness of the image are maintained.

At time T(5), in a case where a black image is input as display data (S100), since its difference in lightness from the image of the immediately preceding display data is smaller than a threshold value, it is not determined that an unintended black image is detected (NO in S102).

On this occasion, since the image input as the display data is a black image, the target value of brightness BL of backlight 5 is set to a lower limit value BL(0), and correction amount C of the brightness of the image is set to an upper limit value C(1).

As a result, from time T(5) to time T(6), brightness BL of backlight 5 decreases, whereas correction amount C of the brightness of the image increases, as time elapses.

At time T(6), in a case where a light image is input as display data, the target value of brightness BL of backlight 5 is set to upper limit value BL(1), and correction amount C of the brightness of the image is set to lower limit value C(0).

As a result, from time T(6) to time T(7), brightness BL of backlight 5 increases as time elapses, until it reaches upper limit value BL(1) at time T(7). In addition, correction amount C of the brightness of the image decreases as time elapses, until it reaches lower limit value C(0) at time T(7).

At time T(7), when brightness BL of backlight 5 reaches upper limit value BL(1) and correction amount C of the brightness of the image reaches lower limit value C(0), brightness BL of backlight 5 is maintained at upper limit value BL(1), and correction amount C of the brightness of the image is maintained at lower limit value C(0).

At time T(8), in a case where a black image is input as display data and its difference in lightness from the image of the immediately preceding display data is larger than the threshold value, it is determined that an unintended black image is detected (YES in S102). Since the value of the counter in timer unit 38 is already initialized, counting is started (S104). Since the counting is not stopped (NO in S108) until a predetermined time elapses after the counting is started, the target value of brightness BL of backlight 5 immediately before the detection of the black image serves as a current target value, and correction amount C of the brightness of the image immediately before the detection of the black image serves as current correction amount C.

As a result, brightness BL of backlight 5 is maintained at upper limit value BL(1), and correction amount C of the brightness of the image is maintained at lower limit value C(0).

At time T(9), in a case where a light image is input as display data (S100, NO in S102), the target value of brightness BL of backlight 5 is set to upper limit value BL(1), and correction amount C of the brightness of the image is set to lower limit value C(0).

As a result, brightness BL of backlight 5 is maintained at upper limit value BL(1), and correction amount C of the brightness of the image is maintained at lower limit value C(0).

Accordingly, after time T(7), brightness BL of backlight 5 and correction amount C of the brightness of the image are maintained constant, irrespective of whether or not an unintended black image is detected.

<In a Case where the Present Invention is not Applied>

Figure 4:
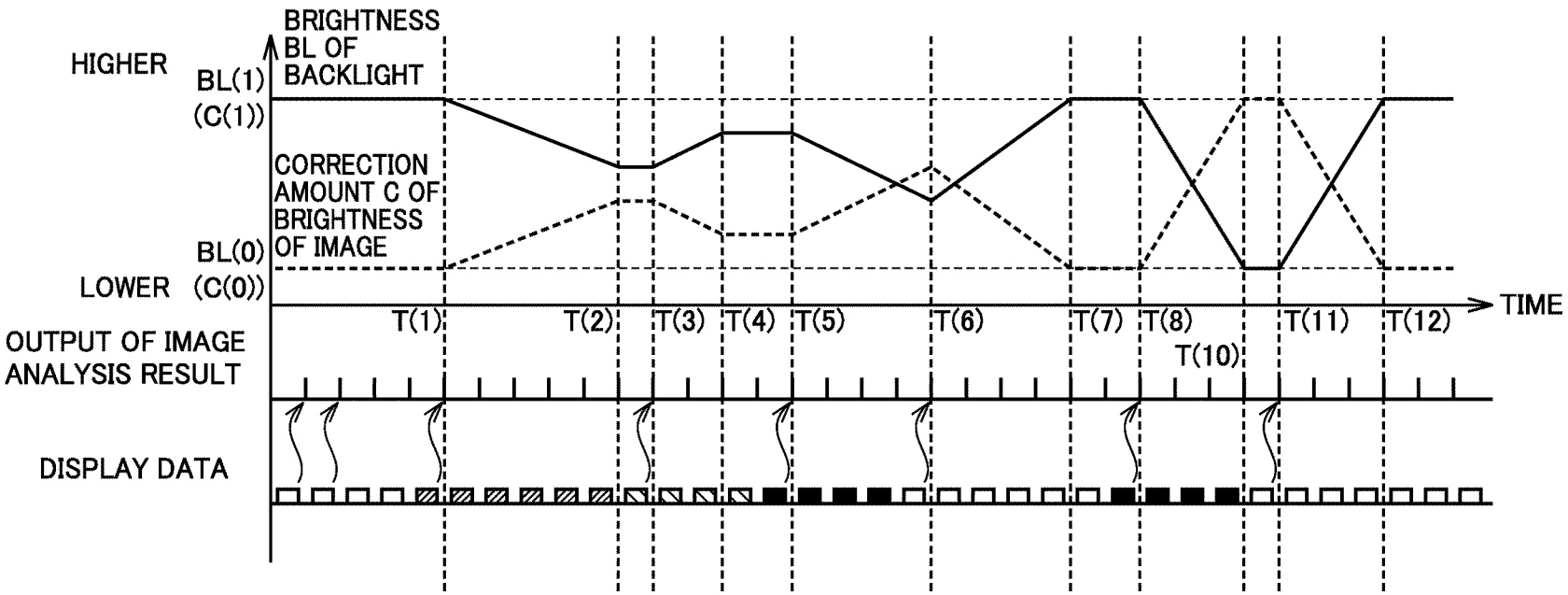
FIG. 4 is a timing chart illustrating an operation of the control device in a case where the present invention is not applied.

It is assumed that, in FIG. 4, the same display data as that in FIG. 3 is input. Therefore, changes in brightness BL of backlight 5 and changes in correction amount C of the brightness of the image from time T(1) to time T(7) in FIG. 4 are identical to changes in brightness BL of backlight 5 and changes in correction amount C of the brightness of the image from time T(1) to time T(7) in FIG. 3. Thus, the detailed description thereof will not be repeated.

At time T(8), in a case where input display data is a black image, the target value of brightness BL of backlight 5 is set to lower limit value BL(0), and correction amount C of the brightness of the image is set to upper limit value C(1).

As a result, from time T(8) to time T(10), brightness BL of backlight 5 decreases, whereas correction amount C of the brightness of the image increases, as time elapses.

At time T(10) to time T(11), when brightness BL of backlight 5 reaches lower limit value BL(0) and correction amount C of the brightness of the image reaches upper limit value C(1), brightness BL of backlight 5 and correction amount C of the brightness of the image are maintained.

At time T(11), in a case where a light image is input as display data, the target value of brightness BL of backlight 5 is set to upper limit value BL(1), and correction amount C of the brightness of the image is set to lower limit value C(0).

As a result, from time T(11) to time T(12), brightness BL of backlight 5 increases, whereas correction amount C of the brightness of the image decreases, as time elapses.

Accordingly, from time T(8) to time T(10), due to the detection of an unintended black image, brightness BL of backlight 5 decreases sharply from upper limit value BL(1) to lower limit value BL(0), and correction amount C of the brightness of the image increases sharply from lower limit value C(0) to upper limit value C(1).

Thereafter, at time T(11) to time T(12), since the display data is restored to a light image, brightness BL of backlight 5 increases sharply from lower limit value BL(0) to upper limit value BL(1), and correction amount C of the brightness of the image decreases sharply from upper limit value C(1) to lower limit value C(0). Such significant changes in brightness BL of backlight 5 and correction amount C of the brightness of the image cause flicker.

As described above, according to image display device 1 in accordance with the present embodiment, in a case where a plurality of images are displayed continuously, when an unintended black image is detected in the plurality of images, correction of the brightness of backlight 5 and the brightness of the image is suppressed until a predetermined time elapses after the black image is detected. Thereby, changes in brightness BL of backlight 5 and correction amount C of the brightness of the image due to display of the black image can be suppressed. As a result, occurrence of flicker can be suppressed. Therefore, an image display device suppressing deterioration of display quality, a control method for the image display device, a control program for the image display device, and a recording medium recording the control program can be provided.

It should be understood that the embodiment disclosed herein is illustrative and non-restrictive in every respect. The scope of the present invention is defined by the scope of the claims, rather than the description above, and is intended to include any modifications within the scope and meaning equivalent to the scope of the claims.

REFERENCE SIGNS LIST

1: image display device; 2: control device; 3: display driver; 4: liquid crystal panel; 5: backlight; 30: image processing unit; 32: image analysis unit; 34: backlight control unit; 36: black image detection unit; 38: timer unit.

The invention claimed is:

1. An image display device, comprising:

a liquid crystal panel displaying an image;

a light source illuminating said liquid crystal panel; and a control device correcting brightness of said light source and brightness of said image, wherein in a case where a plurality of images are displayed continuously, when a black image is detected from said plurality of images, said control device suppresses correction of the brightness of said light source and the brightness of said image until a predetermined time elapses after said black image is detected.

2. The image display device according to claim 1, wherein, in the case where said plurality of images are displayed continuously, when said black image is detected and a difference in lightness between said black image and an image detected immediately before has a magnitude larger than a threshold value, said control device suppresses the correction of the brightness of said light source and the brightness of said image until said predetermined time elapses after said black image is detected.

3. The image display device according to claim 1, wherein, in a case where detection of said black image continues for more than or equal to said predetermined time, said control device cancels suppression of the correction of the brightness of said light source and the brightness of said image.

4. The image display device according to claim 1, wherein said control device makes correction to increase the brightness of said image while decreasing the brightness of said light source as said image has a lower lightness, and makes correction to decrease the brightness of said image while increasing the brightness of said light source as said lightness is higher.

5. The image display device according to claim 1, wherein said predetermined time is set such that there occurs no flicker due to the correction of the brightness of said light source and the brightness of said image based on detection of said black image.

6. The image display device according to claim 1, wherein said control device determines whether or not said image is a black image based on a histogram of said image.

7. A control method for an image display device including a liquid crystal panel displaying an image and a light source illuminating said liquid crystal panel, comprising the steps of:

correcting brightness of said light source and brightness of said image; and in a case where a plurality of images are displayed continuously, when a black image is detected from said plurality of images, suppressing correction of the brightness of said light source and the brightness of said image until a predetermined time elapses after said black image is detected.

8. A recording medium recording a control program for an image display device including a liquid crystal panel displaying an image and a light source illuminating said liquid crystal panel, said control program causing a computer to perform the steps of:

correcting brightness of said light source and brightness of said image; and in a case where a plurality of images are displayed continuously, when a black image is detected from said plurality of images, suppressing correction of the brightness of said light source and the brightness of said image until a predetermined time elapses after said black image is detected.

* * * * *